United States Patent [19]

Kawashima

[11] Patent Number: 4,954,114

[45] Date of Patent: Sep. 4, 1990

[54] COMBINATION TOY WITH A COVER AND INNER MEMBERS

[76] Inventor: Atuko Kawashima, 1641-28A, 3rd Ave., New York, N.Y. 10128

[21] Appl. No.: 418,201

[22] Filed: Oct. 6, 1989

[51] Int. Cl.[5] ..... A63H 33/04; A63H 3/00; A63H 33/00

[52] U.S. Cl. ..... 446/75; 446/268; 446/486; 446/901

[58] Field of Search ..... 446/75, 901, 76, 77, 446/74, 73, 72, 71, 476, 478, 486, 330, 268; 272/234, 282, DIG. 30; 434/272

[56] References Cited

U.S. PATENT DOCUMENTS

| | | | |
|---|---|---|---|
| 1,390,667 | 9/1921 | Bonestell | 446/73 X |
| 1,479,252 | 1/1924 | Richards | 446/73 X |
| 1,543,351 | 6/1925 | Webb | 446/369 |
| 2,282,871 | 5/1942 | Malbon | 273/282 A |
| 2,359,999 | 10/1944 | Langhofer | 446/74 X |
| 3,159,403 | 12/1964 | Glass et al. | 273/282 R |
| 3,680,865 | 8/1972 | Davis | 273/239 |
| 4,197,670 | 4/1980 | Cox | 446/901 X |
| 4,288,222 | 9/1981 | Kling | 446/901 X |
| 4,435,915 | 3/1984 | Zaruba et al. | 446/478 X |
| 4,671,514 | 6/1987 | Wilson-Diehl | 446/901 X |
| 4,737,129 | 4/1988 | Gorley et al. | 446/268 |
| 4,822,285 | 4/1989 | Summerville | 446/369 X |

FOREIGN PATENT DOCUMENTS

| | | | |
|---|---|---|---|
| 1257666 | 12/1971 | United Kingdom | 446/901 |
| 2051593 | 1/1981 | United Kingdom | 446/369 |

OTHER PUBLICATIONS

"The Vegimals" Freemountain Toys, Inc., Playthings, p. 30, Jul. 1978.

*Primary Examiner*—Robert A. Hafer
*Assistant Examiner*—D. Neal Muir
*Attorney, Agent, or Firm*—Kanesaka and Takeuchi

[57] ABSTRACT

A combination toy comprises a cover and a plurality of inner members disposed in the cover, similar to a vegetable or fruit. The cover is provided with a first engaging device fixed inside the cover and a closing device at one side so that inside of the cover can be seen from outside when the closing device is opened. Each inner member is provided with a second engaging device so that the inner member can be detachably attached to the first engaging device. Also, the inner members have signs, such as faces different from each other.

7 Claims, 1 Drawing Sheet

COMBINATION TOY WITH A COVER AND INNER MEMBERS

BACKGROUND OF THE INVENTION

The present invention relates to a combination toy including a cover and inner members detachably retained inside the cover, which is similar to a vegetable or fruit in shape.

Toys similar to vegetables or fruits are popular. However, this kind of conventional toys simply resembles to actual vegetables or fruits.

Accordingly, an object of the present invention is to provide a combination toy with a cover and inner members, wherein the cover resembles to an actual shape of vegetable or fruit and the inner members are modified for attraction.

Another object of the invention is to provide a combination toy as stated above, which can be used for decoration.

A further object of the invention is to provide a combination toy as stated above, which can be used as learning materials for children.

A still further object of the invention is to provide a combination toy as stated above, which is safe for children.

Further objects and advantages of the invention will be apparent from the following description of the invention.

SUMMARY OF THE INVENTION

In accordance with the present invention, a combination toy comprises a cover made of a flexible material and a plurality of soft inner members detachably retained in the cover. The cover is provided with at least one first engaging device fixed inside the cover, and a closing device at one side of the cover. When the closing device is opened, inside of the cover can be substantially completely seen.

Each inner member is provided with a second engaging device at one side so that the inner member can be detachably attached to the first engaging device, and a sign fixed onto the inner member to identity the same. The sign on the inner member may be a face, wherein the respective inner members have different faces. The inner members may have other signs, such as coins or bills.

The cover may be provided with a loop so that the cover can be hung on a wall. Also, each inner member may have a third engaging device engaging the second engaging device. The third engaging device is formed at a side opposite to the second engaging device so that the inner members may be attached to each other.

DETAILED DESCRIPTION OF PREFERRED EMBODIMENTS

Figure 1:
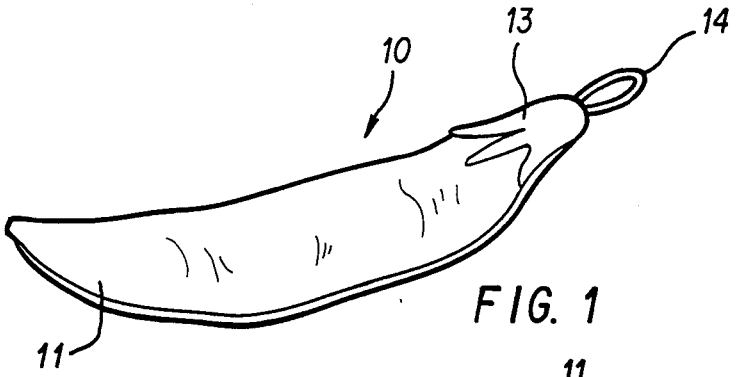
FIG. 1 is a perspective view of one embodiment of a combination toy of the present invention.
Figure 2:
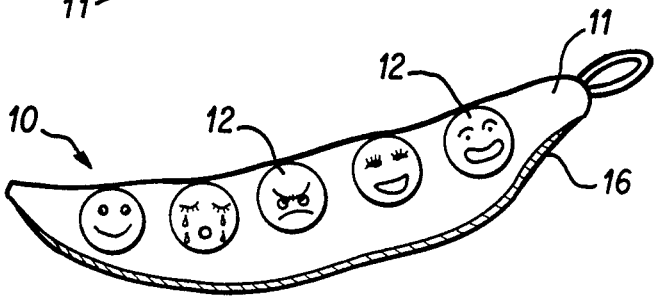
FIG. 2 is a perspective view of the combination toy of FIG. 1, wherein an upper part of a cover is eliminated.
Figure 3:
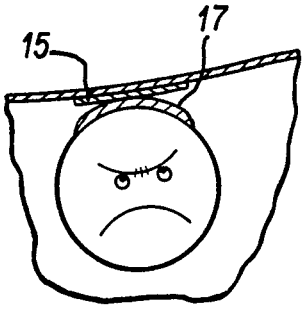
FIG. 3 is an enlarged plan view of a part of the combination toy of FIG. 2.

Referring to FIGS. 1 to 3, a first embodiment 10 of a combination toy of the present invention is shown. The combination toy 10 comprises a cover or pod 11, and five peas 12 having different faces.

The cover 11 is formed of a flexible cloth, and includes a calyx 13 and a loop 14 for hanging the cover 11 on a wall. Inside the cover 11, five retaining devices 15, such as Velcro fastener, are fixed to hold the peas 12 therein. A zipper 16 is provided at an opposite side of the retaining devices 15. When the zipper 16 is closed, the cover 11 becomes a holder, and when the zipper 16 is opened, an inside of the cover 11 can be substantially completely seen.

The peas 12 are made of soft materials and have thick disk shapes. However, the peas 12 may be sphere or any other shapes. Each pea 12 is provided with a retaining device 17 at one side, which is detachably fixed to the retaining devices 15. Therefore, the peas 12 are retained inside the cover 11 without movement.

The peas 12 have signs thereon, such as smiling, laughing, crying, surprise and angry faces. These faces are good for toys for children. Also, each pea 12 may have different color. As a gift for adult, the peas 12 may have signs of coins or bills.

Figure 4:
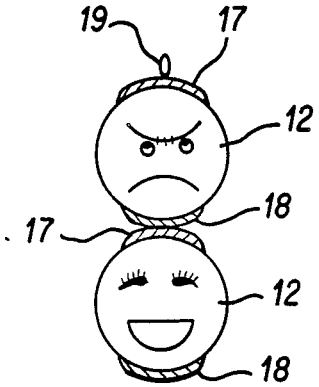
FIG. 4 is a plan view of a different embodiment of inner members.

As shown in FIG. 4, each pea 12 may have a retaining device 18 at a side opposite to the retaining device 17, and a loop 19. The retaining device 18 detachably engages the retaining device 17, so that the peas 12 may be connected together. The peas 12 may hang on a wall by means of the loop 19.

In the combination toy 10, the peas 12 are retained inside the cover 11 by means of the retaining devices 15, 17. When the zipper 16 is opened, the cover 11 may be turned so that the inside, i.e. peas 12, can be seen. Also, the peas 12 may be removed from the cover 11 by simply fulling out the same. The peas 12 may be played as balls. Further, the peas 12 may be attached together and hung on a wall, as shown in FIG. 4.

Namely, the combination toy 10 may be hung on a wall by means of the loop 14 for decoration. Also, the combination toy 10 may be actually played.

Figure 5:
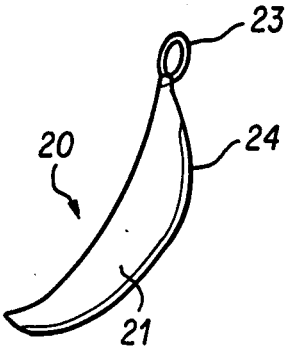
FIG. 5 is a perspective view of a different embodiment of a combination toy of the invention.
Figure 6:
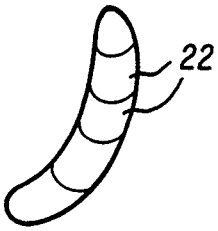
FIG. 6 is a perspective view of inner members of the combination toy of FIG. 5.
Figure 7:
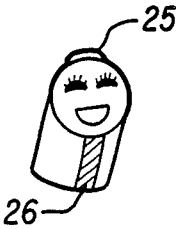
FIG. 7 is an enlarged perspective view of one inner member of the combination toy of FIG. 5.

FIGS. 5–7 show a second embodiment 20 of the combination toy of the present invention. The toy 20 comprises a cover or peel 21 similar to a banana, and a banana meat formed of five sections 22. The peel 21 includes a loop 23 for hanging the same on a wall, and a zipper 24.

Each section 22 of the banana meat has a face different from each other similar to the peas 12, and retaining devices 25, 26, such as Velcro fasteners. The retaining device 25 can be detachably fixed to a retaining device (not shown) inside the peel 21. The retaining device 26 may be connected to the retaining device 25 of a different section 22.

In the toy 20, side portions of each section 22 may be at least partially formed of retaining devices, such as Velcro fasteners, so that the sections 22 can be connected together as one piece to form a banana meat.

In the present invention, a cover is provided with a zipper, and inner members are retained in the cover. Therefore, in case the toy is made similar to a pod or banana, it is attractive for children. The toy may be useful for an active toy or decoration.

While the invention has been explained with reference to the specific embodiments of the invention, the explanation is illustrative and the invention is limited only by the appended claims.

What is claimed is:

1. A combination toy comprising:

a cover made of a flexible material and having a closing device at one side so that inside of the cover can be substantially completely disclosed when the closing device is opened, and at least one first engaging device fixed inside the cover at a side opposite to the closing device, and a plurality of inner members removably disposed in the cover, each inner member having the same size and shape with each other, each inner member including a second engaging device at one side so that the inner member can be detachably attached to the first engaging device, a third engaging device at a side opposite to the second engaging device for detachably engaging another second engaging device so that the inner members can be detachably engaged with each other in any desired order, and a sign fixed onto the inner member, said signs of the inner members being different from each other to identify the respective inner members.

2. A combination toy according to claim 1, further comprising a loop attached to the cover so that the cover can be hung.

3. A combination toy according to claim 1, wherein each inner member has a loop at a top portion thereof so that the inner member can be hung.

4. A combination toy according to claim 1, wherein each inner member is made of a soft material, and the sign of each inner member is a face different from others.

5. A combination toy according to claim 3, wherein said cover is formed in the shape of a pod, and the inner members are formed in the shape of peas.

6. A combination toy according to claim 3, wherein said cover is formed in the shape of a banana peel, and the inner members are formed in the shape of sliced banana meat.

7. A combination toy comprising:

a cover made of a flexible material and having a closing a cover made of a flexible material and having a closing device at one side so that inside of the cover can be substantially completely disclosed when the closing device is opened, at least one first engaging device fixed inside the cover at a side opposite to the closing device, and a loop attached to the cover so that the cover can be hung, and a plurality of inner members removably disposed in the cover, each inner member having the same size and shape with each other, each inner member including a second engaging device at one side so that the inner member can be detachably attached to the first engaging device, a third engaging device at a side opposite to the second engaging device for detachably engaging another second engaging device so that the inner members can be detachably engaged with each other in any desired order, a loop provided at a top portion so that each inner member can be hung, and a sign fixed onto the inner member, said signs of the inner members being faces different from each other to identify the respective inner members.

* * * * *